US007275495B2

(12) United States Patent
Lawrence et al.

(10) Patent No.: US 7,275,495 B2
(45) Date of Patent: Oct. 2, 2007

(54) FLAGPOLE BEACON

(76) Inventors: Mike Lawrence, 3600 Cantrell Industrial Ct., Acworth, GA (US) 30101; Vicki Lawrence, 3600 Cantrell Industrial Ct., Acworth, GA (US) 30101

( * ) Notice: Subject to any disclaimer, the term of this patent is extended or adjusted under 35 U.S.C. 154(b) by 10 days.

(21) Appl. No.: 11/178,972

(22) Filed: Jul. 11, 2005

(65) Prior Publication Data

US 2005/0247257 A1 Nov. 10, 2005

Related U.S. Application Data

(63) Continuation of application No. 10/752,832, filed on Jan. 7, 2004, now abandoned.

(60) Provisional application No. 60/439,888, filed on Jan. 14, 2003.

(51) Int. Cl.
*F21S 8/00* (2006.01)
*G09F 17/00* (2006.01)

(52) U.S. Cl. ..... 116/174; 362/431

(58) Field of Classification Search ..... 116/173, 116/174

See application file for complete search history.

(56) References Cited

U.S. PATENT DOCUMENTS 1,171,917 A * 2/1916 Axford ..... 116/173
1,383,234 A * 6/1921 Raguse ..... 116/173
1,660,341 A * 2/1928 Lapworth ..... 116/173
1,773,350 A * 8/1930 Drum ..... 116/173
1,878,447 A * 9/1932 Sutphen ..... 116/173
1,913,672 A * 6/1933 Huking ..... 116/173
2,507,623 A * 5/1950 Diaz ..... 116/174
2,586,643 A * 2/1952 Garlow ..... 116/173
3,476,929 A * 11/1969 Klinger ..... 116/173
5,988,100 A * 11/1999 Schmitt ..... 116/173
6,227,683 B1 * 5/2001 Tukia ..... 362/303
2003/0193804 A1 * 10/2003 Schroeder ..... 362/253

* cited by examiner

*Primary Examiner*—Richard Smith
*Assistant Examiner*—Travis Reis
(74) *Attorney, Agent, or Firm*—Bryan W. Bockhop

(57) ABSTRACT

The present invention relates to an environmentally friendly beacon or light for illuminating a pole-mounted, halyard-hoisted flag, banner, pennant or the like that has a luminous source located in a cover, is mounted on top of the pole, and is capable of continuously directing a narrow beam of light toward the flag, banner, pennant or the like as the wind blows the same around the pole. The flagpole beacon of the present invention is designed to replace the knob of an existing pole and may be used on poles having either an internal halyard configuration or an external halyard configuration.

18 Claims, 6 Drawing Sheets

FLAGPOLE BEACON

CROSS-REFERENCE TO RELATED APPLICATIONS

This application is a continuation of U.S. patent application Ser. No. 10/752,832, filed Jan. 7, 2004 now abandoned which claims the benefit of priority of U.S. provisional application No. 60/439,888, filed Jan. 14, 2003, which is incorporated herein by reference.

FIELD OF THE INVENTION

The present invention relates generally to a beacon or light for illuminating a pole-mounted flag, banner, pennant or the like. In particular, the present invention relates to an environmentally friendly beacon or light that has a luminous source located in a cover, is mounted on top of the pole, and is capable of continuously directing a narrow beam of light toward the flag, banner, pennant or the like as the wind blows the same around the pole.

BACKGROUND OF THE INVENTION

Pole-mounted flags, banners, pennants and the like, whether representative of a nation, company, university, athletic team, or other organization, represent a source of pride to those who display them. Generally, such flags and the like cannot be adequately displayed at night because of poor visibility. Because many people would prefer that their flag be seen at all times of the day or night and at any time of the year, it is common to try to illuminate such flags so that they are always visible.

Conventionally, this has been accomplished by pointing a floodlight located on the ground up toward the sky in the general direction of the pole-mounted flag. The use of floodlights, however, has several drawbacks. First, depending on the voltage range used, installing a floodlight may require applying for and obtaining a license. Second, floodlights are often expensive to purchase, expensive to operate on a daily basis, and difficult to use and maintain. Third, the intensely bright, broad beam from a floodlight typically illuminates more of the sky than of the flag, thereby providing unsatisfactory visibility for the flag and adding to the not-insignificant problem of atmospheric light pollution.

These drawbacks to the use of floodlights for illuminating pole-mounted flags, banners, pennants and the like gave rise to various solutions which involve mounting a light source in close proximity to the flag, typically at or near the top of the pole. U.S. Pat. No. 1,660,341, for instance, discloses attaching a translucent closure to the upper end of the pole and placing a light source inside the closure to project rays of light upon the flying flag. While such a device allows for the use of less light than a floodlight, it still does not solve the problem of illuminating more of the surrounding sky than the flag itself.

Accordingly, improvements in the art have incorporated placing reflective surfaces above the light source in order to direct the light downward toward the flag, banner, pennant, or the like. For example, U.S. Pat. No. 3,476,929 describes mounting a reflector cone to the top of the pole. This reflector cone has a light source inside, an inner surface coated with a reflective material, and a base with four lenses for light to pass through. As a result of this design, light from the light source is reflected downward by the reflective material through the lenses to illuminate the area around the pole. Similarly, U.S. Pat. No. 6,227,683 proposes the use of a knob having a light source inside, a cover whose upper portion is opaque and whose lower portion is translucent, and a reflecting surface located inside the cover but above the light source. Thus, light from the light source is reflected downward by the reflecting surface through the translucent lower portion of the cover to illuminate the area around the pole. Although such devices reduce the amount of atmospheric light pollution by focusing the light downward, they fail to focus the light directly on the flag, banner, pennant or the like. Such devices illuminate the entire area around the pole even though the flag is only on one side of the pole at any given time.

To better focus the light directly on the flag, banner, pennant or the like, lighting devices have been created that place the light source immediately adjacent to the flag. Specifically, U.S. Pat. No. 1,171,917 discloses arranging several light sources adjacent to the hoist or staff end of the flag. Likewise, U.S. Pub. No. 2003/0193804 proposes placing a light source within a transparent portion of the flag-mounted pole, immediately adjacent the flag. Both of these designs incorporate the use of reflectors which focus the light directly toward the flag and which are adapted to pivot around the pole in proper relation to the flag as the flag changes positions due to directional changes in air flow. These and similar devices are advantageous because they illuminate only the flag, banner, pennant or the like and are capable of maintaining such illumination as the wind causes the flag to rotate around the pole. The problem with such devices is that they are not adaptable to existing poles. Because placing a light source adjacent to the flag, rather than above the flag, involves manipulating the structure of the pole, this solution is not favored by those who wish to add illumination to their existing flag, banner, or pennant display.

Therefore, a need exists for an improved beacon or light for illuminating a flag, banner, pennant or the like that reduces atmospheric light pollution by focusing light directly toward the flag, maintains focused illumination as the flag rotates around the pole due to changes in air flow, and is adaptable to existing poles.

SUMMARY OF THE INVENTION

The present invention answers this need by providing an environmentally friendly beacon or light that has a luminous source located in a cover, is mounted on top of the pole, and is capable of continuously directing a narrow beam of light toward the flag, banner, pennant or the like as the wind blows the same around the pole.

Generally described, the present invention relates to a beacon or light for a pole-mounted, halyard-hoisted flag, banner, pennant or the like having at least one light source and a cover surrounding the at least one light source, wherein the cover has at least one opening through which light can pass. The at least one opening of the cover is positioned such that light from the at least one light source is focused directly toward the flag. The beacon or light also includes a truck for allowing the cover to rotate which is connected to the cover and to the top of the pole and a pulley through which the halyard passes. The pulley is operationally associated with the truck and the cover such that when the flag responds to a change in wind direction, the pulley and cover rotate about the pole with the flag and cause light to be continuously directed from the at least one light source toward the flag.

An object of the present invention is to provide a simple, inexpensive solution for illuminating a flag, banner, pennant or the like.

A further object of the present invention is to provide a beacon or light that can be installed and used without difficulty on both existing poles and on newly manufactured poles.

Another object of the present invention is to provide a beacon or light that can be installed and used on poles having an internal halyard configuration and on poles having an external halyard configuration.

Yet another object of the present invention is to provide a beacon or light which is applicable to poles in both the vertical and diagonal positions.

Another object of the present invention is to provide a beacon or light that minimizes atmospheric light pollution.

The present invention provides a simple and inexpensive solution for placing a light source at the top of both new and existing poles for illuminating flags, pennants, banners, and the like. Specifically, the solution involves replacing the typical non-luminous knob located at the top of most poles with the beacon of the present invention.

Other objects, features, and advantages of the present invention will become apparent upon inspection of the following detailed description of the preferred embodiment of the invention, taken in conjunction with the drawings and appended claims.

DETAILED DESCRIPTION OF THE INVENTION

Figure 1:
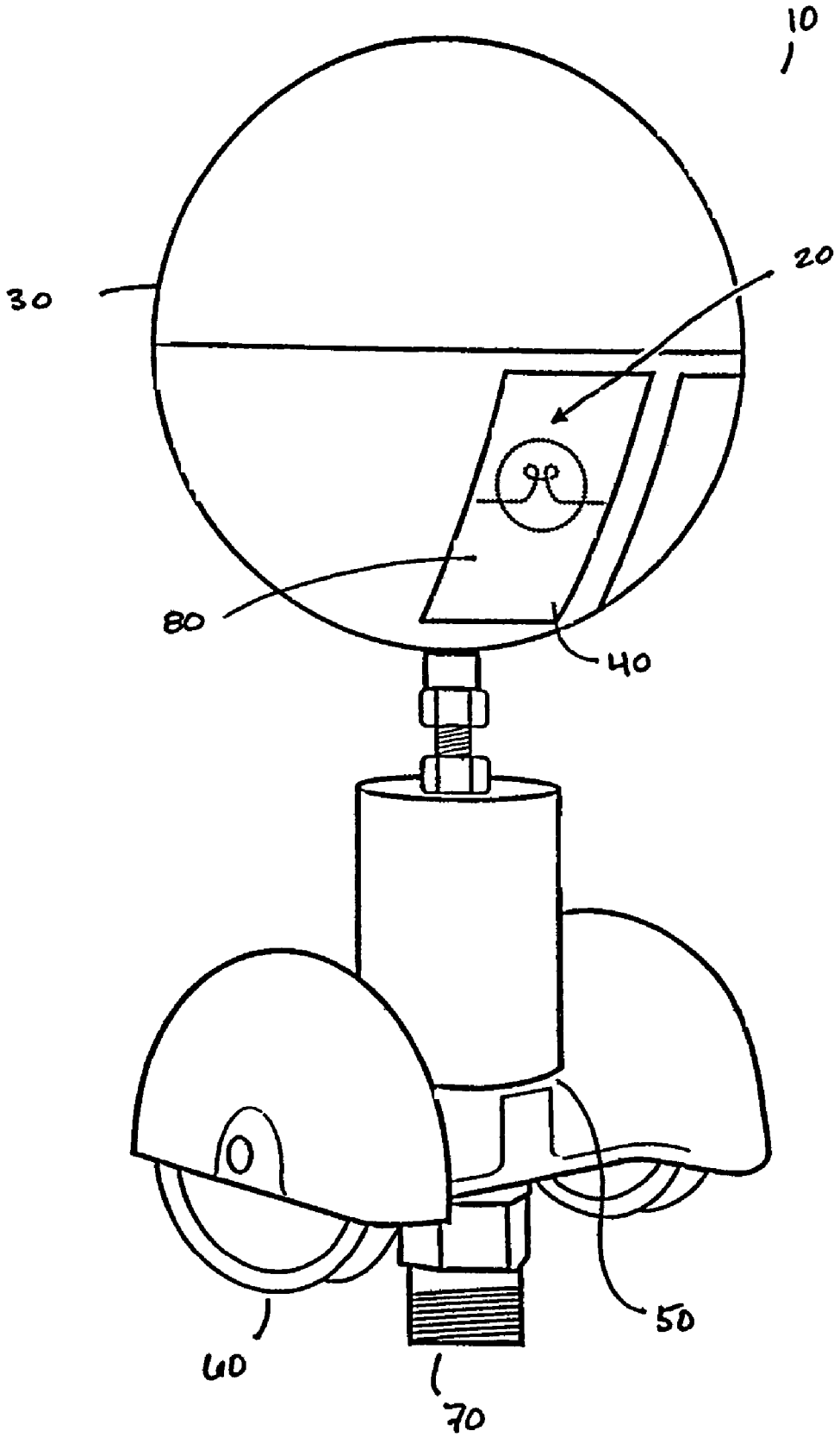
FIG. 1 is a perspective view of a flagpole beacon in accordance with the present invention.
Figure 2:
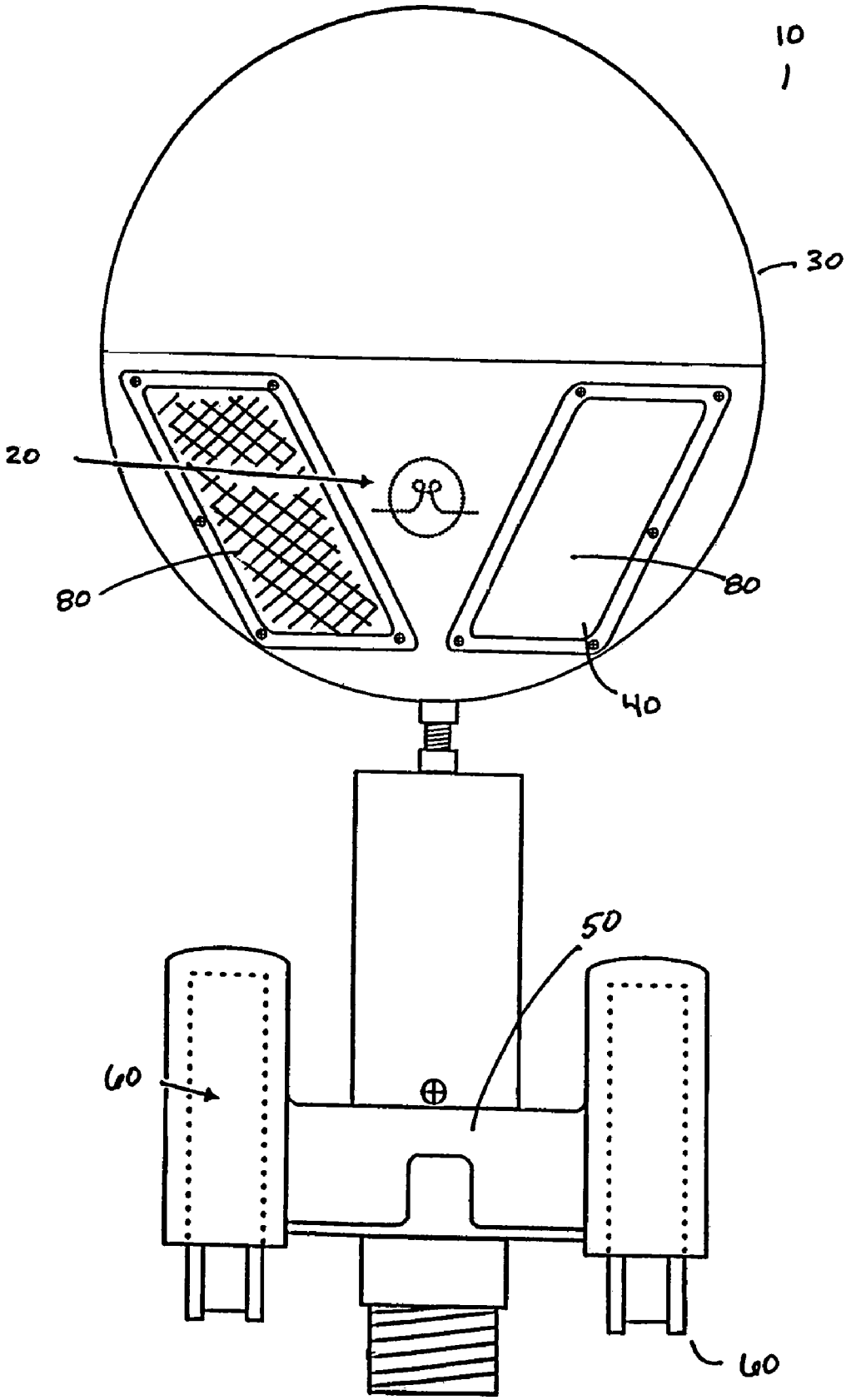
FIG. 2 is a front view of a flagpole beacon in accordance with the present invention.
Figure 3:
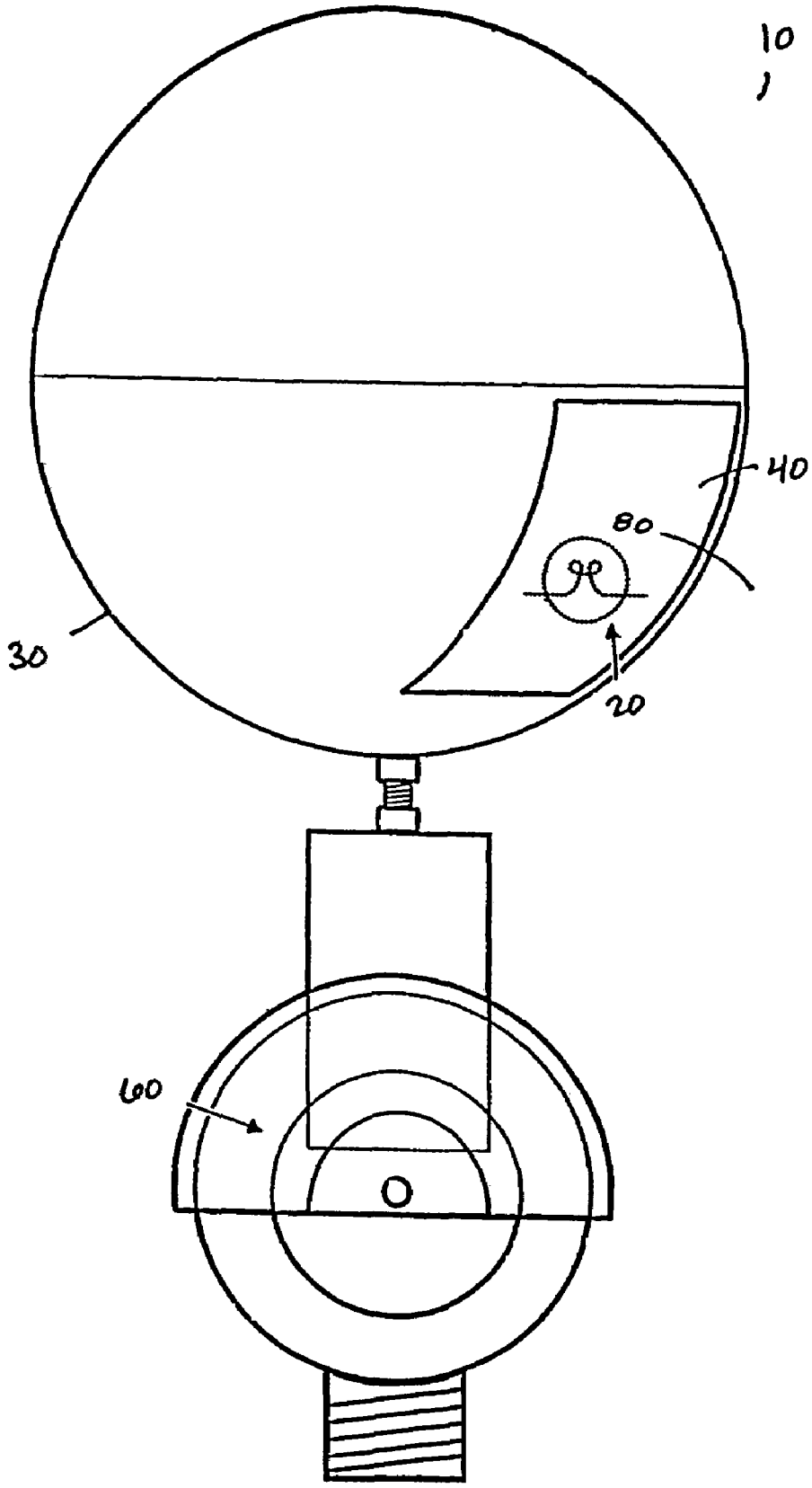
FIG. 3 is a side view of a flagpole beacon in accordance with the present invention.

Referring to FIGS. 1, 2 and 3, the present invention provides a flagpole beacon 10 for a pole-mounted, halyard-hoisted flag, banner, pennant or the like. The flagpole beacon 10 includes at least one light source 20 and a cover 30 surrounding the at least one light source 20, wherein the cover 30 has at least one opening 40 through which light can pass. The at least one opening 40 of the cover 30 is positioned such that light from the at least one light source 20 is focused directly toward the flag.

The cover 30 of the flagpole beacon 10 manufactured according to this embodiment may be constructed of any suitable formable or fabricated material, shaped to form any existing design, and colored any coordinating or contrasting color depending upon the desire to coordinate or contrast the flagpole beacon 10 with the color of the pole. Preferably cover 30 is constructed from anodized aluminum, shaped to form a ball or sphere having an appropriate diameter depending on the flag and flag pole size, advantageously about eight (8) inches, and colored gold. Conventional low voltage bulbs are suitable for use as the at least one light source 20 inside the cover 30. The wattage of the bulbs used in the flagpole beacon 10 of the present invention may vary greatly depending on many factors, however under normal conditions the wattage advantageously ranges from about 20 to about 50 W, depending on the desired luminous intensity. Any type of bulb or illumination may be used, including halogen, xenon, LED, and the like. The size and shape of the at least one opening 40 of the cover 30 may vary depending upon the size of the flag, banner, pennant, or the like desired to be illuminated and whether all or only a portion of the flag, banner, pennant, or the like is to be illuminated. The flagpole beacon 10 of the present invention may also contain reflectors within the beacon if it is desired to increase the area and/or intensity of illumination. The at least one opening 40 of the cover 30 may be a void or may contain a lens 80. The lens 80 may comprise any transparent material, colored material, translucent material, or the like. Preferably lens 80 comprises an optically clear polycarbonate material.

The flagpole beacon 10 of the present invention also includes a truck 50 for allowing the cover 30 to rotate. The truck 50 is connected to the cover 30 and to the top of the pole. In addition, the flagpole beacon 10 includes pulley 60 through which the halyard passes. Pulley 60 is operationally associated with the truck 50 and the cover 30 such that when the flag responds to a change in wind direction, pulley 60 and cover 30 rotate about the pole with the flag and cause light to be continuously directed from the at least one light source 20 toward the flag.

Advantageously the present invention is a beacon or light for a flag, banner, pennant or the like attachable to a pole comprising at least one light source within the beacon or light for electrical connection to a power source; a cover surrounding said at least one light source, said cover having at least one opening through which light can pass; a truck for allowing said cover to rotate, said truck being connected to said cover and to the top of the pole; and a pulley through which a halyard passes, said pulley being operationally associated with said truck and said cover such that when the flag responds to a change in wind direction, the pulley and cover rotate about the pole with the flag and wherein said at least one opening is positioned on said cover such that light from said at least one light source is directed toward the flag.

Industrially manufactured poles are generally hollow and include a separate knob portion that is secured to the pole by a fitting. The flagpole beacon 10 of the present invention is designed, like the separate knob portion of industrially manufactured poles, to be secured to the top of a pole by means of a fitting 70. Thus, the flagpole beacon 10 of the present invention may be used to replace the separate knob portion of an existing pole with a means of illuminating the flag, banner, pennant or the like.

Advantageously, all electrical components necessary to operate the present invention may be contained within the flagpole beacon 10 and the pole. The electrical power is provided through a rotary contact within the base of the truck 50. Any power source can be used to energize the at least one light source 20, such as a battery or line current supplied through a transformer. The flagpole beacon 10 may be operated by an on/off switch at the base of the pole or at a remote location. Alternatively, the flagpole beacon 10 may be activated by an on-at-dusk, off-at-dawn switch.

Figure 4:
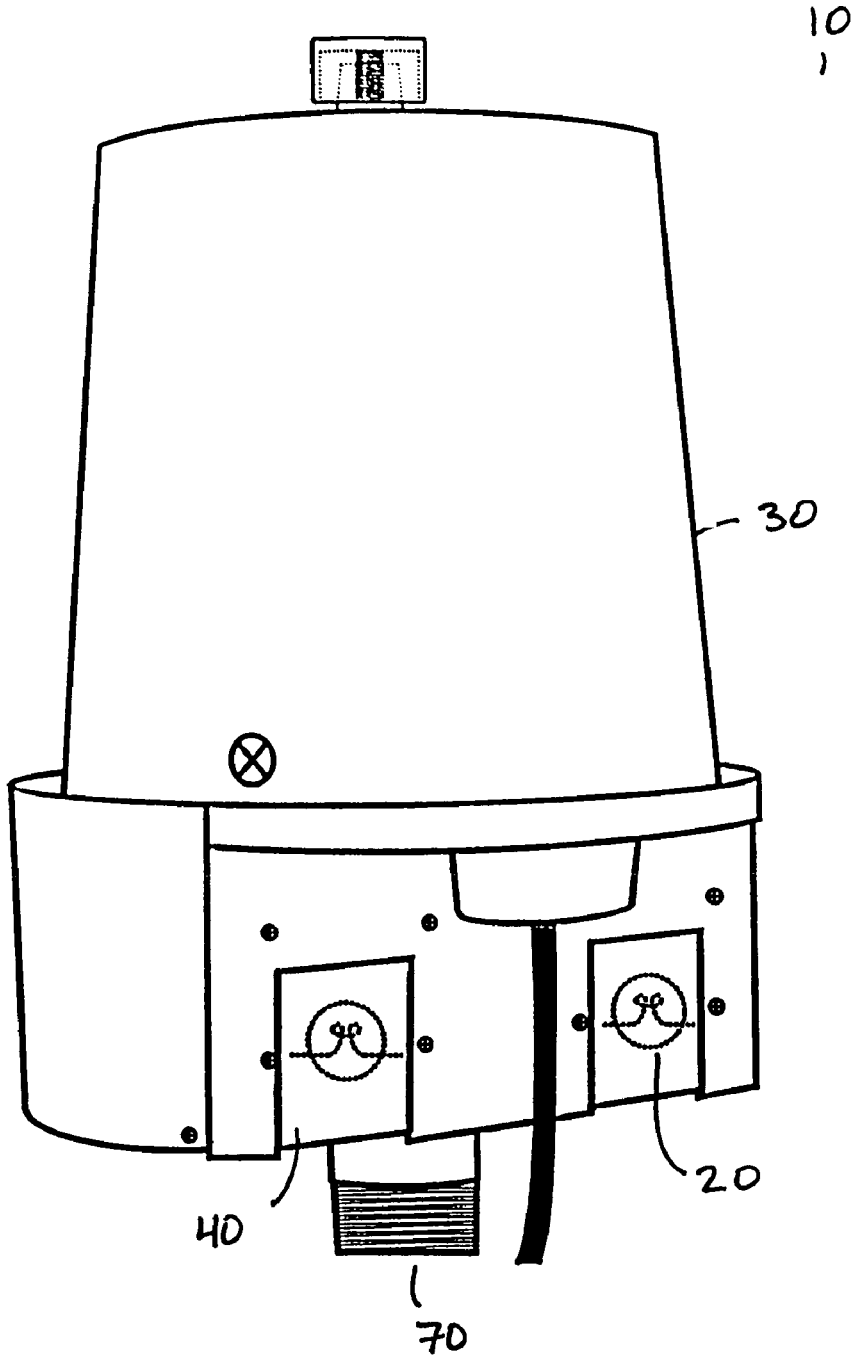
FIG. 4 is a perspective view of an alternative embodiment of the flagpole beacon in accordance with the present invention.
Figure 5:
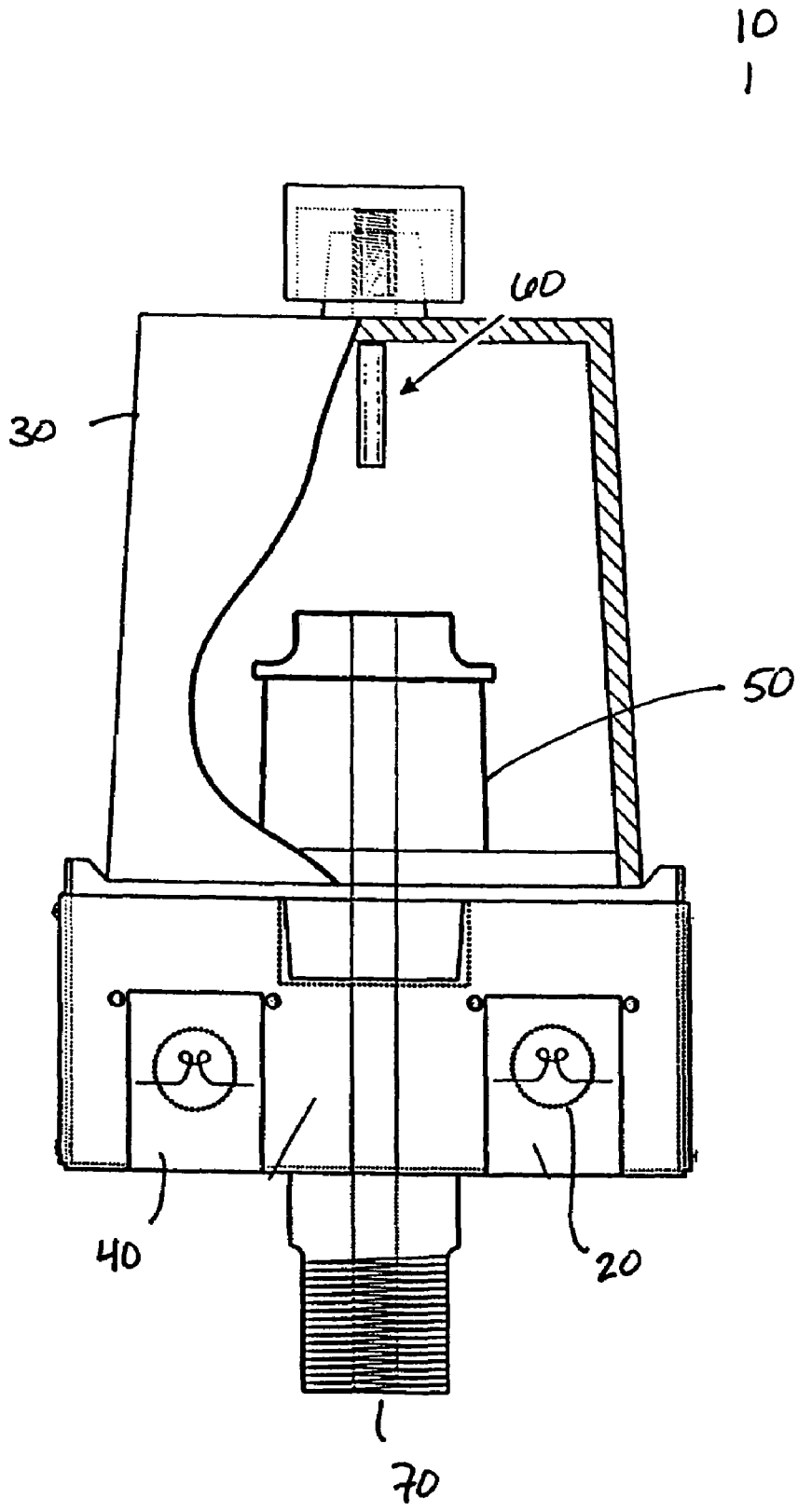
FIG. 5 is a cut-away front view of an alternative embodiment of the flagpole beacon in accordance with the present invention.
Figure 6:
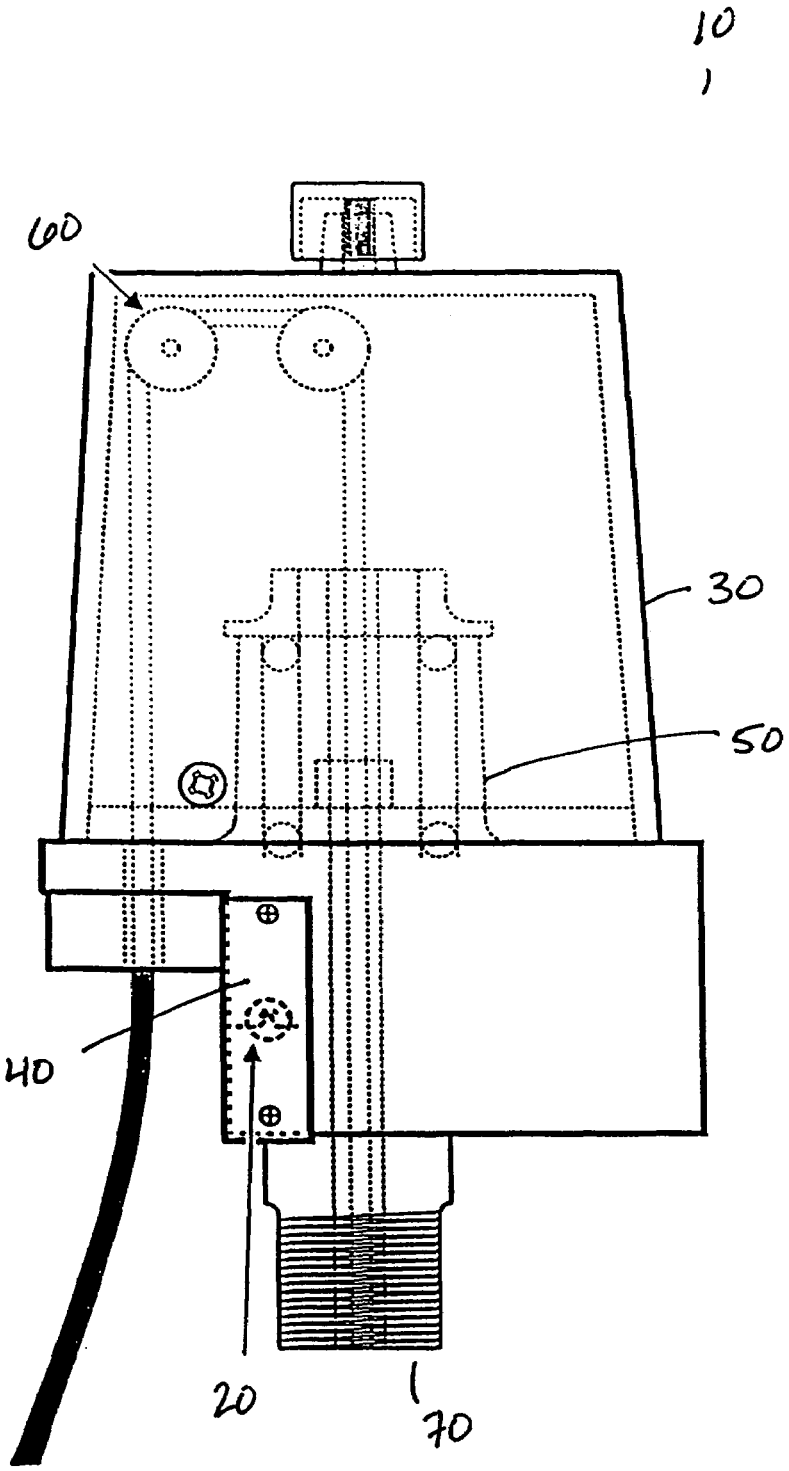
FIG. 6 is a cross-sectional side view of an alternative embodiment of the flagpole beacon in accordance with the present invention.

In the embodiment currently described, the flagpole beacon 10 of the present invention is designed for use on poles having an external halyard configuration. Thus, pulley 60 is located external to the cover 30 so that pulley 60 may receive the halyard external to the pole. FIGS. 4, 5, and 6 depict an alternative embodiment of a flagpole beacon 10 according to the present invention which is designed for use on poles having an internal halyard configuration. Accordingly, pulley 60 of the flagpole beacon 10 of this alternative embodiment is located internal to the cover 30 so that pulley 60 may receive the halyard internal to the pole.

Although this invention has been described in specific detail with reference to the disclosed embodiments, it will be understood that many variations and modifications may be affected within the spirit and scope of the invention as described in the following claims.

What is claimed is:

1. A beacon for illuminating a flag attached to a halyard that is coupled to a flag pole, the flag pole having a vertical axis and including a top end, the beacon comprising:

a. a truck that includes a fitting configured for mounting on the top end of the flag pole, the truck including a top portion that is mounted upon the fitting and rotatably engaged with the fitting and configured to rotate about the vertical axis;

b. a light source mounted above the top portion of the truck;

c. an opaque cover that encloses the light source, the cover being substantially concentric with the flag pole and affixed to the top portion of the truck so as to be rotatable therewith, the cover defining at least one opening that forms a narrow beam of light from the light source that is directed downwardly and radially outwardly from the light source toward the flag, the opening having a shape so that the beam is directed in the direction of the flag and not toward a side of the flag pole opposite from which the flag has rotated; and d. a pulley configured for engagement with the halyard, the pulley coupled to the top portion of the truck so that when the flag responds to a change in wind direction, the pulley causes the top portion of the truck and the cover to rotate so that the beam of light tracks the flag.

2. The beacon of claim 1, wherein the cover includes a metal portion.

3. The beacon of claim 2, wherein the metal portion is made from a material selected from a group consisting essentially of: aluminum, aluminum alloys, anodized aluminum, steel, and steel alloys and combinations thereof.

4. The beacon of claim 1, wherein the opening includes a lens disposed therein.

5. The beacon of claim 4, wherein the lens includes a transparent material.

6. The beacon of claim 4 wherein the lens includes a colored material.

7. The beacon of claim 4, wherein the lens is made of optically clear polycarbonate.

8. The beacon of claim 1 wherein the pulley is located external to the cover.

9. The beacon of claim 1 wherein the pulley is contained within the cover.

10. The beacon of claim 1, wherein the opening includes a first lens and a spaced-apart second lens, the first lens disposed so as to illuminate a first side of the flag and the second lens disposed so as to illuminate a second opposite side of the flag.

11. The beacon of claim 1, wherein the light source includes a first lamp and a spaced-apart second lamp, the first lamp disposed so as to illuminate a first side of the flag and the second lamp disposed so as to illuminate a second opposite side of the flag.

12. A beacon for illuminating a flag attached to a halyard that is coupled to a flag pole, the flag pole having a vertical axis and including a top end, the beacon comprising:

a. a truck that includes a fitting configured for mounting on the top end of the flag pole, the truck including a top portion that is mounted upon the fitting and rotatably engaged with the fitting and configured to rotate about the vertical axis;

b. a light source mounted above the top portion of the truck;

c. an opaque cover that encloses the light source, the cover being substantially concentric with the flag pole and affixed to the top portion of the truck so as to be rotatable therewith, the cover defining two openings, each opening forming a narrow beam of light from the light source that is directed downwardly and radially outwardly from the light source toward a different side of the flag, each opening having a shape so that the beam is directed in the direction of the flag and not toward a side of the flag pole opposite from which the flag has rotated; and d. a pulley configured for engagement with the halyard, the pulley coupled to the top portion of the truck so that when the flag responds to a change in wind direction, the pulley causes the top portion of the truck and the cover to rotate so that the each beam of light tracks the flag.

13. The beacon of claim 12, wherein the cover includes a metal portion.

14. The beacon of claim 13, wherein the metal portion is made from a material selected from a group consisting essentially of: aluminum, aluminum alloys, anodized aluminum, steel, and steel alloys and combinations thereof.

15. The beacon of claim 12, wherein each opening includes a lens disposed therein that is configured to focuse the light beam on the flag.

16. The beacon of claim 15 wherein the lens includes a colored material.

17. The beacon of claim 15, wherein the lens is made of optically clear polycarbonate.

18. The beacon of claim 12, wherein the light source includes a first lamp and a spaced-apart second lamp, the first lamp disposed so as to illuminate a first side of the flag and the second lamp disposed so as to illuminate a second opposite side of the flag.

* * * * *